United States Patent [19]

Keat

[11] 4,334,895

[45] Jun. 15, 1982

[54] GLASS BONDED ABRASIVE TOOL CONTAINING METAL CLAD GRAPHITE

[75] Inventor: Paul P. Keat, Shrewsbury, Mass.

[73] Assignee: Norton Company, Worcester, Mass.

[21] Appl. No.: 154,356

[22] Filed: May 29, 1980

[51] Int. Cl.[3] ..... B24D 3/02

[52] U.S. Cl. ..... 51/309; 51/293; 51/307

[58] Field of Search ..... 51/293, 307, 309

[56] References Cited

U.S. PATENT DOCUMENTS 2,332,241 10/1943 Lombard et al. ..... 51/308
3,402,035 9/1968 Martin ..... 51/298
3,454,384 7/1969 Kumagal ..... 51/295
4,157,897 6/1979 Keat ..... 51/295

*Primary Examiner*—Donald E. Czaja
*Assistant Examiner*—W. Thompson
*Attorney, Agent, or Firm*—Rufus M. Franklin

[57] ABSTRACT

Glass bonded grinding wheels including graphite or other inert dry film lubricant filler can be made by conventional techniques if the filler material is protected from oxidation by a metal cladding. Diamond or cubic boron nitride wheels are particularly described and high grinding ratios are achieved. Low porosity can be achieved because of the wettability of the metal cladding by the glass during firing.

1 Claim, No Drawings

GLASS BONDED ABRASIVE TOOL CONTAINING METAL CLAD GRAPHITE

FIELD OF THE INVENTION

The invention relates to grinding wheels bonded by a glass matrix containing dry film lubricant particles protected by a metal cladding.

BACKGROUND OF THE INVENTION

The use of solid dry lubricant particles in grinding wheels is well-known; the use of graphite particles in a vitrified or glass bonded wheel is taught in U.S. Pat. No. 3,454,384, to Kumagai, and in U.S. Pat. No. 4,157,897 to Keat, the inventor herein.

The use of particulate graphite in grinding wheels provides a method of wheel grade control (hardness of the wheel), improves the thermal conductivity (thus lowering the temperature at the grinding face), acts as a lubricant (lowering the generation of heat), and acts to prevent formation of a coherent film of workpiece material or bond material which would interfere with grinding and cause loading of the wheel.

One disadvantage of using graphite in glass bonded wheels is the fact that known glassy bonds do not readily wet the graphite particles, and thus it is difficult to achieve a low porosity wheel.

The Kumagai patent relates to wheels which have a bond having the constitution of a hard graphite pencil and thus include a large amount of graphite in a fired clay matrix. The bond includes a large amount of porosity which is impregnated with a lubricating agent such as stearic acid which melts at or below the grinding temperature.

The Keat patent relates to hot pressed wheels and includes no temporary "green" binder in the mix.

U.S. Pat. No. 3,402,035 to Martin teaches the use of metal clad graphite in a resin or metal bonded diamond wheel to improve the bonding of the graphite to the metal or resin matrix.

Conventional bonds for glass (vitrified) bonded grinding wheels contain organic temporary or "green" bonding material such as starches or sugars to hold the wheel together before the glass bond is developed by firing. During the manufacture of the wheel, or other grinding tool, after molding and before firing to the vitrification temperature, it is necessary to remove the organic binding by heating the wheels in an oxidizing atmosphere. Such oxidizing conditions, adequate to remove the temporary binder, also would remove any graphite or other equally readily oxidizable conventional dry film lubricant. Thus conventional manufacturing techniques for making ceramic or glass bonded grinding tools (vitrified bonded) do not permit the use of conventional dry film lubricants such as graphite, molybdenum sulfide, hexagonal boron nitride, and zinc sulfide.

SUMMARY OF THE INVENTION

The inability to employ readily oxidizable particulate dry film lubricants in conventionally manufactured ceramic grinding tools is overcome by the expedient, in the present invention, of employing metal clad particulate lubricant material. The metal cladding may be any protective metal melting above 700° C., which can be coated on the finely divided particles of graphite or other dry film lubricant. Vapor deposition, electroplating, electroless plating, or any other conventional method of producing the coating may be employed. Typical suitable metals to be used as coatings are nickel, copper, silver, cobalt, and chromium.

In manufacture of the wheels, the abrasive such as diamond, cubic boron nitride, aluminum oxide, or silicon carbide is mixed with a conventional glass binder system such as disclosed in U.S. Pat. No. 2,332,241 to Lombard and Milligan, which discloses the use of dextrine as a green binder for the molded tools in the green state. In accordance with the present invention, a quantity of metal clad graphite, in an amount so as to provide from 10 to no more than 60% of graphite, by volume, in the finished tool, is added to the abrasives, matrix, binder mixture prior to molding.

DESCRIPTION OF SPECIFIC EMBODIMENT OF INVENTION

The following composition was used to produce a mixture from which the diamond section of a grinding wheel was molded:

RVG 120/140 grit (General Electric synthetic diamond): 3.88 gm
SiC powder filler: 3.20
Nickel coated graphite (40 wt% Ni): 2.16
Glass frit (borosilicate glass): 12.50
Glycerin-methylcellulose: 1.52

The above composition is calculated to yield a diamond section containing 20 bond volume % graphite at a nominal diamond concentration of 75 (12½% by volume).

The preform material for the wheel center is a vitrified bonded mix containing glass (sodium, aluminoborosilicate) plus SiC filler. Its weight was 130 gm. The diamond rim is formed on the the outer periphery of the preform.

The diamond section sample mix was prepared in standard fashion by weighing in succession into a mixing bowl; SiC filler, nickel-coated graphite and glass bond—these 3 items were dry mixed 2× by screening thru 165 mesh; diamond was then added and mix screened 1× through 72 mesh; binder was then added, mixed by stirring and total mix screened once through 24 mesh.

The preform mix was weighted and poured into the specified preform mold. It was pressed to a preliminary volume; transferred to a (larger) wheel mold; the diamond mix added to the peripheral volume; and the diamond section/preform pressed simultaneously together to the final cold-pressed volume at a pressure of approximately 18 t.s.i.

The fired wheel was finished to dimension by standard lapping and grinding manufacturing procedures.

In dry grinding of cemented tungsten carbide, wheels of the above constitution out-performed conventional commercial resin bonded diamond wheels containing the same level of graphite, by a factor of 8 to 9 times (based on the volume ratio material ground to wheel wear), even though the amount of diamond per unit volume of wheel was ⅓ less, in the invention wheel.

It has been shown by the practice of this invention that the metal cladding on the graphite is wet by the glass. Thus diamond sections of very low porosity can be made. The example diamond section had a porosity of 7.6%, but diamond sections of lower porosity down to 3% or less can also be made by this technique.

What is claimed is:

1. A grinding wheel having a grinding face including abrasive particles selected from the group consisting of diamond, cubic boron nitride, alumina, and silicon carbide, said abrasive particles being held in a glass matrix, said glass matrix including therein particles of an oxygen reactive dry film, lubricant, said lubricant particles being encapsulated in a metal coating selected from the group consisting of nickel, cobalt, silver, copper, and alloys thereof, said coating being of sufficient thickness to protect said lubricant particles from oxidation during manufacture of the wheel.

* * * * *